US012716326B2

(12) United States Patent
Fripp et al.

(10) Patent No.: US 12,716,326 B2
(45) Date of Patent: Aug. 25, 2026

(54) DEEP-SET INSERT VALVE USING MAGNETIC COUPLING

(71) Applicant: Halliburton Energy Services, Inc., Houston, TX (US)

(72) Inventors: Michael Linley Fripp, Singapore (SG); Mohan Gunasekaran, Singapore (SG); Kevin Robin Passmore, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/079,242

(22) Filed: Mar. 13, 2025

(65) Prior Publication Data

US 2025/0297530 A1 Sep. 25, 2025

Related U.S. Application Data

(60) Provisional application No. 63/567,728, filed on Mar. 20, 2024.

(51) Int. Cl.
*E21B 34/10* (2006.01)

(52) U.S. Cl.
CPC ..... *E21B 34/107* (2013.01); *E21B 2200/05* (2020.05)

(58) Field of Classification Search
None
See application file for complete search history.

(56) References Cited

U.S. PATENT DOCUMENTS

| | | | |
|---|---|---|---|
| 7,967,074 | B2 | 6/2011 | Lake et al. |
| 11,668,160 | B1 | 6/2023 | Passmore et al. |
| 12,163,403 | B1 | 12/2024 | Zhong et al. |

(Continued)

FOREIGN PATENT DOCUMENTS

| | | | |
|---|---|---|---|
| WO | 2020041056 | A1 | 2/2020 |
| WO | 2021173684 | A1 | 9/2021 |

OTHER PUBLICATIONS

Halliburton. "DepthStar Tubing-Retrievable Safety Valve." Halliburton Data Sheet, 2024. H013828 Oct. 2024. PDF file. 2 pages.

(Continued)

*Primary Examiner* — David Carroll
(74) *Attorney, Agent, or Firm* — Scott Richardson; C. Tumey Law Group PLLC

(57) ABSTRACT

A downhole system may include an insert frame securable within a central bore of a tubing retrievable safety valve that has driver magnet configured to project a magnetic field and move axially along a control line in the tubing retrievable safety valve. The downhole system may include an insert flapper connected to the insert frame and configured to actuate between an open position and a closed position to control fluid flow through the central bore. The downhole system may include an insert flow tube configured to move along the central bore to drive the insert flapper between the closed position and the open position. Further, the downhole system may include a follower magnet secured to the insert flow tube and magnetically engaged with the driver magnet. The follower magnet is configured to move in response to movement of the driver magnet to drive movement of the insert flow tube.

20 Claims, 8 Drawing Sheets

(56) References Cited

U.S. PATENT DOCUMENTS

2009/0032238 A1* 2/2009 Rogers ..... E21B 34/066 166/332.8
2009/0071654 A1* 3/2009 O'Malley ..... E21B 34/105 166/321
2010/0294502 A1 11/2010 Xu
2011/0240299 A1* 10/2011 Vick, Jr. ..... E21B 34/10 137/511
2012/0032099 A1* 2/2012 Vick, Jr. ..... F16K 31/086 251/65
2015/0000982 A1* 1/2015 Mcdowell ..... F16K 3/03 175/57
2020/0240235 A1 7/2020 Fripp et al.
2021/0032983 A1 2/2021 Inglis et al.
2021/0108487 A1* 4/2021 Vick, Jr. ..... F16K 1/2007
2021/0332674 A1 10/2021 Greci et al.
2022/0065818 A1 3/2022 Werkheiser et al.
2022/0186606 A1 6/2022 Werkheiser et al.
2022/0307347 A1 9/2022 Dusterhoft et al.
2022/0341285 A1 10/2022 Werkheiser et al.
2023/0366311 A1 11/2023 Fripp et al.
2023/0399907 A1 12/2023 Passmore et al.
2023/0399914 A1 12/2023 Passmore et al.
2023/0399919 A1* 12/2023 Passmore ..... E21B 34/066
2023/0417123 A1 12/2023 Wood et al.
2023/0417124 A1 12/2023 Wood et al.
2023/0417125 A1 12/2023 Wood et al.
2024/0052722 A1 2/2024 Passmore et al.
2024/0076955 A1* 3/2024 Chin ..... E21B 34/16
2024/0218908 A1 7/2024 Scott et al.
2024/0287880 A1 8/2024 Fripp et al.
2024/0295158 A1 9/2024 Mitchell et al.
2024/0301767 A1* 9/2024 Gonzalez ..... E21B 34/16
2025/0198255 A1 6/2025 Gunasekaran et al.
2025/0207493 A1 6/2025 Gunasekaran et al.

OTHER PUBLICATIONS

Halliburton. "EcoStar Electric Tubing-Retrievable Safety Valve." Halliburton Data Sheet, 2024. H012530 Dec. 2024. PDF file. 2 pages.

International Search Report and Written Opinion for International Patent Application No. PCT/US2025/019945 dated Jul. 2, 2025. PDF file. 9 pages.

* cited by examiner

DEEP-SET INSERT VALVE USING MAGNETIC COUPLING

CROSS-REFERENCE TO RELATED APPLICATIONS

The present application is a non-provisional conversion application of U.S. Provisional Application Ser. No. 63/567,728, filed Mar. 20, 2024, the entire disclosure of which is incorporated herein by reference.

BACKGROUND

During production operations of a wellbore, crude oil may flow upward through production tubing and/or casing to the surface. To control flow in the event of a well failure, a tubing retrievable safety valve (TRSV) may be mounted to production tubing or casing installed downhole in the wellbore. The tubing retrievable safety valve may be configured to close automatically in response to a predetermined flow condition (e.g., pressure differential/flow velocity across the subsurface safety valve) indicative of well failure. Closing the subsurface safety valve includes moving a flapper of the tubing retrievable safety valve from an open position to a closed position to block the flow in the production tubing and/or casing.

However, tubing retrievable safety valves may fail over time. Generally, to restore control of the flow through the tubing retrievable safety valve, an insert valve may be run-in-hole and secured within the tubing retrievable safety valve. Insert valves may include respective insert flow tubing and insert flappers that may also move between an open position and a closed position to control fluid flow through the tubing retrievable safety valve. However, providing actuation power (e.g., hydraulic power) to move the insert flow tubing and/or insert flappers generally requires cutting and/or drilling into the downhole tubular (e.g., casing, tubing, etc.) of the tubing retrievable safety valve, which may be time consuming and potentially compromise the tubing retrievable safety valve.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for a magnetically driven downhole insert valve and, more particularly, example embodiments may include a magnetically driven downhole insert valve having a secondary follower magnet configured to move in response to movement of a magnetically coupled secondary driver magnet to drive an insert flow tube to move an insert flapper valve between an open position and a closed position. As set forth in greater detail below, the secondary driver magnet may be disposed in a tubing retrievable safety valve and the secondary follower magnet may be secured to the downhole insert valve. As such, the downhole insert valve may be installed without cutting or drilling into the tubing retrievable safety valve.

Figure 1:
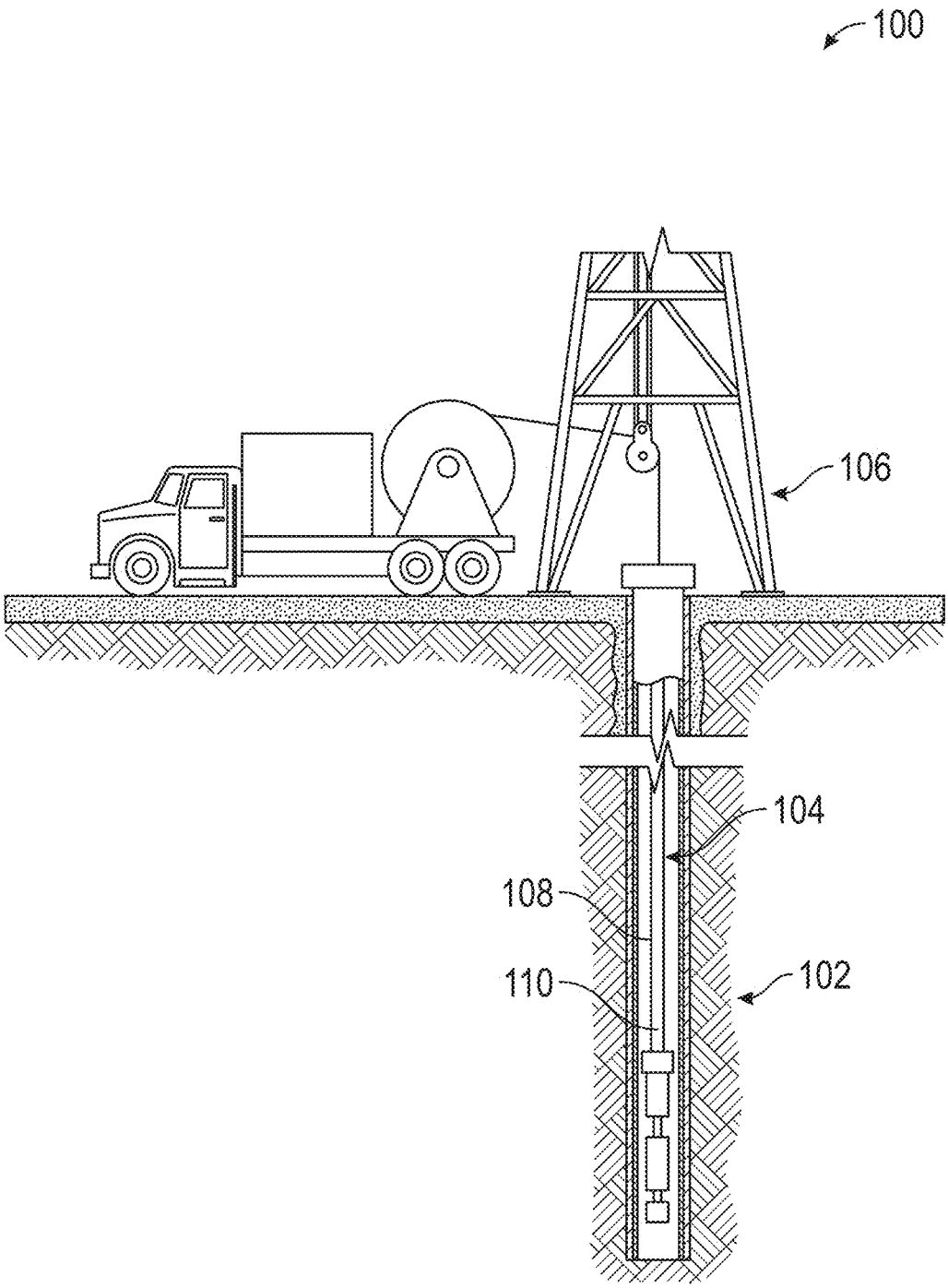
FIG. 1 illustrates an elevation view of an example of a well system, in accordance with some embodiments of the present disclosure.

FIG. 1 is an elevation view of a well system, in which aspects of the present disclosure may be implemented. While FIG. 1 generally depicts land-based operations, the principles described herein are equally applicable to subsea operations that employ floating or sea-based platforms and rigs, without departing from the scope of the disclosure. As illustrated, the well system 100 includes a subsurface safety valve system 102 disposed within a wellbore 104 to prevent the uncontrolled release of subsurface production fluids, should the well system 100 experience a loss in containment. Generally, the subsurface safety valve system 102 (e.g., tubing retrievable subsurface safety valve system) may be run-in-hole to a desired depth as part of a completion string. Alternatively, the subsurface safety valve system 102 (e.g., wireline retrievable subsurface safety valve system) may be lowered to a desired position in the wellbore 104 via wireline.

Moreover, the subsurface safety valve system 102 may be in communication with the surface 106 via a control line 108 (e.g., hydraulic control line, electrical control line, etc.). The control line 108 may provide actuation power to the subsurface safety valve system 102. As set forth in greater detail below, the actuation power may be provided to the subsurface safety valve system 102, via the control line 108, to actuate the subsurface safety valve system 102. For example, as set forth in greater detail below, the control line 108 may include a hydraulic control line configured to increase a pressure in the control line 108 to ultimately open at least one valve 112 (e.g., a primary flapper valve 216) of the subsurface safety valve system 102 (shown in FIG. 2). Opening the at least one valve 112 may provide a flow path for subsurface production fluids to enter a conduit 110 (e.g., completion tubing, casing, casing liner, etc.). Reducing pressure in the control line 108 may ultimately close the at least one valve of the subsurface safety valve system 102 to block the flow path into the conduit 110.

However, the primary flapper valve 216 (shown in FIG. 2) of the subsurface safety valve system 102 may fail or malfunction during well operations. In response to failure of the primary flapper valve 216, an insert valve 222 (shown in FIG. 3) may be run-in-hole and secured within the subsurface safety valve system 102. The insert valve 222 may be lowered into the wellbore 104 via wireline. However, the insert valve 222 may be lowered into the wellbore 104 via any suitable tool. Further, as set forth in greater detail below, the insert valve 222 may include a magnetic coupling configured to drive the insert valve 222 between an open position and a closed position. The primary flapper valve 216 is lowered into the wellbore on production tubing and is an integral part of the of the production tubing string.

Figure 2:
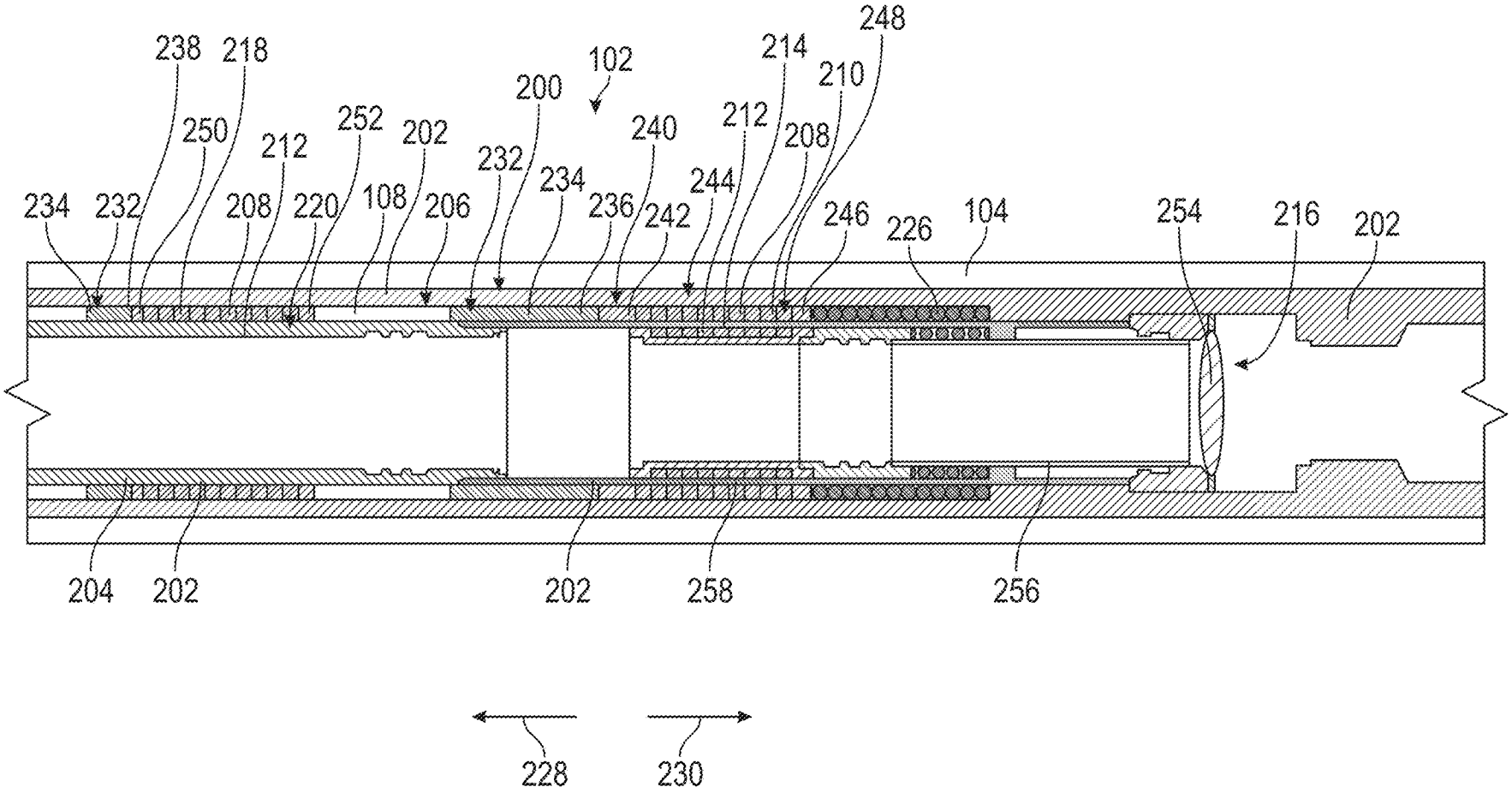
FIG. 2 illustrates a cross-sectional view of a tubing retrievable safety valve with a primary flapper valve magnetically driven into an open position, in accordance with some embodiments of the present disclosure.

FIG. 2 illustrates a cross-sectional view of a tubing retrievable safety valve with a primary flapper valve magnetically driven into an open position, in accordance with some embodiments of the present disclosure. The tubing retrievable safety valve 200 (TRSV) may be run into a borehole (e.g., the wellbore 104) during preparation for production operations. As illustrated, the tubing retrievable safety valve 200 may include a downhole tubular 202 configured to house various components of the tubing retrievable safety valve 200.

Moreover, the downhole tubular 202 may include a central bore 204 in fluid communication with the conduit 110 (e.g., completion tubing, casing, casing liner, etc.) shown in FIG. 1. Additionally, the downhole tubular 202 may also include a channel 206 extending through at least a portion of the downhole tubular 202. The channel 206 may extend in an axial direction with respect to the downhole tubular 202 such that at least a portion of the channel 206 runs parallel to the central bore 204. Further, the channel 206 may form at least a portion of the control line 108 that is configured to provide actuation power to the subsurface safety valve system 102 from the surface 106 (shown in FIG. 1). The control line 108 may be a hydraulic control line, an electrical control line, or any other suitable type of control line for providing actuation power to the tubing retrievable safety valve 200. For example, as illustrated, the channel 206 may form at least a portion of a hydraulic control line.

The tubing retrievable safety valve 200 may include at least one driver magnet 208 (e.g., a primary driver magnet 210) disposed within the control line 108 (e.g., the channel 206). The at least one driver magnet 208 may include any suitable type of magnet (e.g., at least one rare earth permanent magnet, electromagnets, etc.) Moreover, the at least one driver magnet 208 is configured to move axially along the control line 108 between a first driver magnet position (e.g., uphole position) and a second driver magnet position (e.g., a downhole position). Additionally, the at least one driver magnet 208 is configured to project a magnetic field into the central bore 204. As illustrated, the magnetic field is configured to interface with at least one follower magnet 212 (e.g., a primary follower magnet 214) of the tubing retrievable safety valve 200 to actuate a primary flapper valve 216 between the open position and the closed position to control flow through the central bore 204. The at least one follower magnet 212 may include any suitable type of magnet (e.g., at least one rare earth magnet, etc.) Additionally, or alternatively, the magnetic field from the at least one driver magnet 208 (e.g., a secondary driver magnet 218) may be configured to interface with the at least one follower magnet 212 (e.g., a secondary follower magnet 220) of an insert valve 222 to actuate an insert flapper 224 of the insert valve 222 between a closed position and an open position (shown in FIG. 3).

As illustrated, the at least one driver magnet 208 may include the primary driver magnet 210 and the secondary driver magnet 218 each positioned within the control line 108. The secondary driver magnet 218 may be disposed uphole with respect to the primary driver magnet 210. Moreover, as set forth in greater detail below, the primary driver magnet 210 and the secondary driver magnet 218 may be configured to move axially along the control line 108 in response to hydraulic pressure in the control line 108 exceeding a threshold pressure. The threshold pressure may be a pressure that is sufficient to compress a spring 226 disposed in the control line 108 in a position downhole from the primary driver magnet 210 and the secondary driver magnet 218. The spring 226 may be configured to bias the primary driver magnet 210 and the secondary driver magnet 218 in the uphole direction 228. However, the primary driver magnet 210 is configured to move in an axially downhole direction 230 along the control line 108 from a first primary driver magnet position toward a second primary driver magnet position in response to hydraulic pressure in the control line 108 exceeding the threshold pressure. Similarly, the secondary driver magnet 218 is also configured to move in the axially downhole direction 230 along the control line 108 from a first secondary driver magnet position toward a second secondary driver magnet position in response to hydraulic pressure in the control line 108 exceeding the threshold pressure.

The tubing retrievable safety valve 200 may include a driver feature 232 configured to actuate to drive the at least one driver magnet 208 (e.g., the primary driver magnet 210 and the secondary driver magnet 218) in the downhole direction 230 toward their respective second primary driver magnet position and second secondary driver magnet position. For example, the driver feature 232 may include at least one piston 234 disposed within the channel 206 (e.g., the control line 108) and configured to move axially along the control line 108 in response to hydraulic pressure in the control line 108. In particular, a pressure increase in the control line 108 on an uphole side of the at least one piston 234 may be configured to drive the at least one piston 234 in the downhole direction 230. However, the at least one piston 234 may be directly or indirectly coupled to the spring 226 such that downhole movement of the at least one piston 234 may be restrained until the pressure in the control line 108 above the at least one piston 234 exceeds the threshold pressure needed to provide sufficient force for the at least one piston 234 to compress the spring 226 and move in the downhole direction 230.

As illustrated, the driver feature may include a primary piston 236 and a secondary piston 238 each coupled to a respective driver magnet. In particular, the primary piston 236 may be coupled to the primary driver magnet 210 and the secondary piston 238 may be coupled to the secondary driver magnet 218. Additionally, or alternatively, the tubing retrievable safety valve 200 may include respective seals 240 disposed at each axial end of the primary driver magnet 210 and the secondary driver magnet 218 to protect the respective magnets. For example, an upper primary seal 242 may be secured to an upper end 244 of the primary driver magnet 210 and a lower primary seal 246 may be secured to a lower end 248 of the primary driver magnet 210.

Further, as illustrated, the primary piston 236 may be coupled to the primary driver magnet 210 via the upper primary seal 242 and the secondary piston 238 may be coupled to the secondary driver magnet 218 via an upper secondary seal 250. Further, a fluid may be disposed between a lower secondary seal 252 and the primary piston 236 such that the secondary piston 238 and secondary driver magnet 218 are fluidly connected to the primary piston 236 and the primary driver magnet 210. Further, the lower primary seal 246 may be configured to interface with an upper end of the spring 226. During operation, in response to pressure in the control line above the primary piston 236 exceeding the threshold pressure, the secondary piston 238 may drive the secondary driver magnet 218 and its respective seals in the downhole direction 230 toward the second secondary driver magnet position. Due to the fluid connection between the lower secondary seal 252 and the primary piston 236, the primary piston 236 may also be driven in the downhole direction 230. As such, the primary piston 236 may drive the primary driver magnet 210 and its respective seals 240 in the downhole direction 230 toward the second primary driver magnet position. Additionally, the interface between the lower primary seal 246 and the spring 226 may drive the spring 226 to compress.

Moreover, the tubing retrievable safety valve 200 may include the primary flapper valve 216 disposed within a central bore of the downhole tubular 202. As set forth above, the primary flapper valve 216 is configured to actuate between an open position and a closed position to control fluid flow through the central bore 204 of the downhole tubular 202 of the tubing retrievable safety valve 200. For example, a primary flapper 254 of the primary flapper valve 216 may be configured to move to the closed position to seal the central bore 204 and prevent uncontrolled production of oil or gas or in the event of equipment failure.

A primary flow tube 256 of the tubing retrievable safety valve 200 may be configured to drive the primary flapper 254 between the open position and the closed position. The primary flow tube 256 is disposed within the central bore 204 and configured to move between a first primary tube position (e.g., uphole position) and a second primary tube position (e.g., downhole position). The primary flow tube 256 is configured to drive the primary flapper 254 to the open position in the second primary tube position. In particular, as the primary flow tube 256 moves from the first primary tube position toward the second primary tube position, a lower end of the primary flow tube 256 is configured to contact an upper side of the primary flapper 254. Continued movement of the primary flow tube 256 in the downhole direction 230 toward the second primary tube position is configured to drive the primary flapper 254 to hinge from the closed position toward the open position.

Further, the tubing retrievable safety valve 200 may include the at least one follower magnet 212 (e.g., the primary follower magnet 214) that is configured to actuate the primary flapper valve between the open position and the closed position to control flow through the central bore. As illustrated, the primary follower magnet 214 may be secured to the primary flow tube 256. The primary follower magnet 214 may be magnetically engaged with the magnetic field of the primary driver magnet 210. As set forth above, the primary driver magnet 210 may be disposed within the control line 108. The primary follower magnet 214 may be disposed within the central bore 204 proximate to an inner surface 258 of the downhole tubular 202. Further, as illustrated, the primary follower magnet 214 may be axially aligned with the primary driver magnet 210. As such, the primary follower magnet 214 may be positioned in the magnetic field of the primary driver magnet 210 such that the primary follower magnet 214 may be magnetic coupled to the primary driver magnet 210. Thus, movement of the primary driver magnet 210 may drive axial movement of the primary follower magnet 214 disposed within the central bore 204. Additionally, as the primary follower magnet 214 is secured to the primary flow tube 256, movement of the primary follower magnet 214 in response to movement of the primary driver magnet 210 may drive the primary flow tube 256 between the first primary tube position and the second primary tube position to actuate the primary flapper valve 216.

Figure 3:
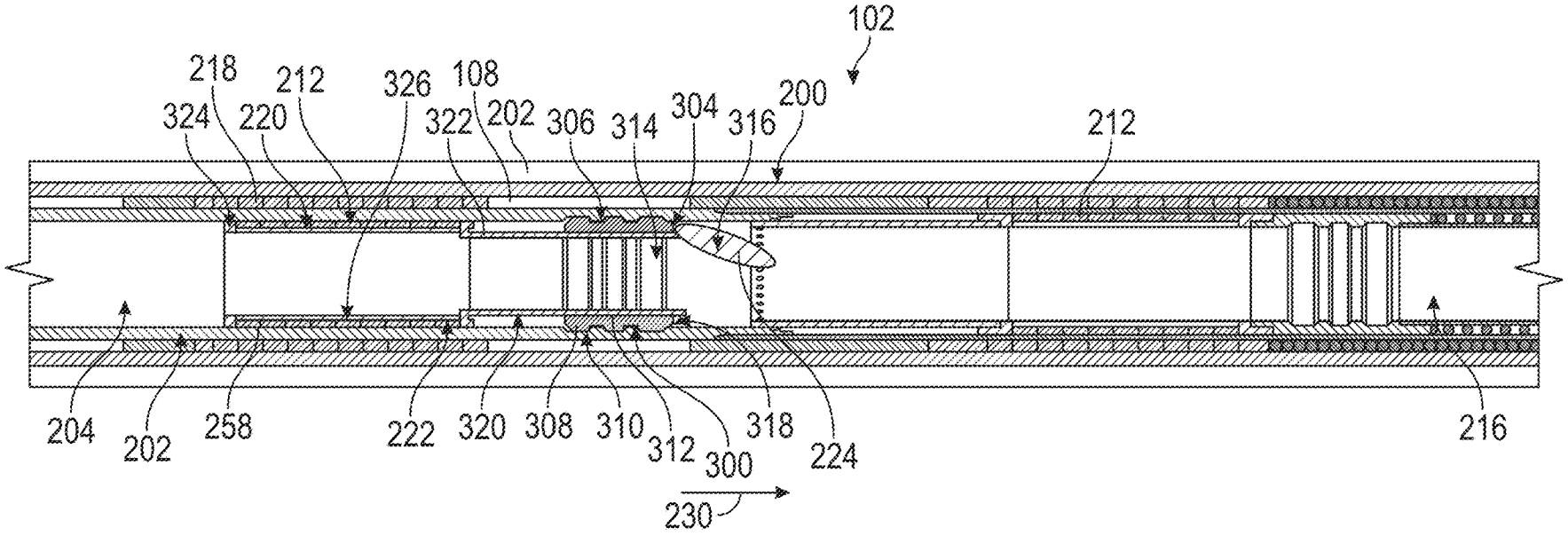
FIG. 3 illustrates a cross-sectional view of a magnetically driven downhole insert valve secured to a tubing retrievable safety valve and disposed in an open position, in accordance with some embodiments of the present disclosure.

FIG. 3 illustrates a cross-sectional view of a magnetically driven downhole insert valve secured to a tubing retrievable safety valve and disposed in an open position within a borehole, in accordance with some embodiments of the present disclosure. As set forth above, the primary flapper valve 216 (shown in FIG. 2) of the subsurface safety valve system 102 may fail or malfunction during well operations. In response to failure of the primary flapper valve 216, the insert valve 222 may be run-in-hole and secured within the subsurface safety valve system 102. The insert valve may function as a backup and/or replacement valve for the primary flapper valve 216 of the tubing retrievable safety valve 200. Similar to the primary flapper valve 216, the insert valve 222 may be configured to open and close to control fluid flow through the downhole tubular 202 of the tubing retrievable safety valve 200.

As illustrated, the insert valve 222 may be run-in-hole to the central bore 204 of the downhole tubular 202 of the tubing retrievable safety valve 200. With the insert valve 222 disposed in the downhole tubular 202, the insert valve 222 may interface with the tubing retrievable safety valve 200 to secure the insert valve 222 to the tubing retrievable safety valve 200. In particular, the insert valve 222 may include an insert lock 300 configured to interface with an inner surface 258 of the downhole tubular 202 to secure an insert frame 304 of the insert valve 222 to the tubing retrievable safety valve 200. Further, the tubing retrievable safety valve 200 may include a landing nipple 306 formed on the inner surface 258 of the downhole tubular 202. The insert lock 300 of the insert valve 222 may be configured to interface with the landing nipple 306 to secure the insert valve 222 to the tubing retrievable safety valve 200. As illustrated, the insert lock 300 may include radially extending ridges 308 configured to interface with corresponding grooves 310 of the landing nipple 306. The grooves 310 may extend circumferentially about the inner surface 258 of the downhole tubular 202. The ridges 308 may include any suitable shape for engaging the grooves 310 to secure the insert valve 222 to the tubing retrievable safety valve 200.

Moreover, as illustrated, the insert frame 304 may be connected to the insert lock 300. In particular, the insert frame 304 may be connected to a downhole end of the insert lock 300. The insert frame 304 and the insert lock 300 may both include substantially tubular shapes. That is, the insert lock 300 may include a substantially tubular shape with the ridges 308 extending radially outward from a main body 312 of the insert lock 300. Further, respective inner surfaces of the insert lock 300 and the insert frame 304 may be substantially radially aligned to form an insert through bore 314 extending through both the insert lock 300 and the insert frame 304. Fluid passing through the central bore 204 of the tubing retrievable safety valve 200 may flow through the insert through bore 314 in an open position of the insert valve 222.

Further, the insert valve 222 may include an insert flapper 224 at least partially secured to the insert frame 304. Alternatively, the insert valve 222 may include a ball valve, a poppet valve, or any other suitable type of insert valve. Moreover, similar to the primary flapper 254 shown in FIG. 2, the insert flapper 224 is configured to actuate between an open and closed position to control fluid flow through the central bore 204. For example, the insert flapper 224 may be connected to a downhole end of the insert frame 304 via a hinged connection 316 such that the insert flapper 224 may hinge between the open position and the closed position. However, the insert flapper 224 may be connected to a downhole end of the insert frame 304 via any suitable connection. Further, a valve seat 318 may be formed at a downhole end of the insert frame 304. The valve seat 318 may include an annular shape corresponding to the insert flapper 224. The insert flapper 224 may be configured to seal against the valve seat 318 in the closed position to block fluid flow through the central bore 204.

Moreover, the insert valve 222 may include an insert flow tube 320 configured to drive the insert flapper 224 between the open position and the closed position. As illustrated, the insert flow tube 320 may include an interface portion 322 and a magnet housing portion 324. However, the insert flow tube 320 may include any suitable portions. Generally, the insert flow tube 320 may be disposed within the central bore 204 of the tubing retrievable safety valve 200. However, the interface portion 322 may include a smaller diameter than the magnet housing portion 324 such that at least a portion of the interface portion 322 may extend through the insert through bore 314 of the insert lock 300 and the insert frame 304. Further, the insert flow tube 320 is configured to move between an uphole position (e.g., a first insert tube position) and a downhole position (e.g., a second insert tube position). The insert flow tube 320 is configured to drive the insert flapper 224 to the open position in the second insert tube position. That is, in the first insert tube position shown in FIG. 4, the interface portion of the insert flow tube 320 may be disposed uphole from the insert flapper 224. However, as the insert flow tube 320 moves from the first insert tube position toward the second insert tube position, the interface portion 322 is configured to move through the insert through bore 314 and contact the insert flapper 224. As illustrated, continued movement of the insert flow tube 320 in the downhole direction 230 toward the second insert tube position is configured to drive the insert flapper 224 to move (e.g., hinge, pivot, rotate, etc.) from the closed position toward the open position.

Moreover, the at least one follower magnet 212 may include the secondary follower magnet 220 (e.g., an insert follower magnet). Moreover, the insert valve 222 may include the secondary follower magnet 220, which may be secured to the magnet housing portion 324 of the insert flow tube 320. In particular, the secondary follower magnet 220 may be disposed about the circumference of the magnet housing portion 324 of the insert flow tube 320. The magnet housing portion 324 of the insert flow tube 320 may include at least one recess 326 configured to house the at least one follower magnet 212. As illustrated, the recess 326 may be formed to position the secondary follower magnet 220 proximate to the inner surface 258 of the central bore 204.

As set forth above, the secondary driver magnet 218 is configured to output a magnetic field configured to interface with the at least one follower magnet 212 (e.g., the secondary follower magnet 220). Further, the secondary driver magnet 218 may be positioned in the control line 108, which is disposed radially outward from the central bore 204. As such, positioning the secondary follower magnet 220 in the central bore 204 proximate to the inner surface 258 of the downhole tubular 202 may minimize the distance between the secondary driver magnet 218 and the secondary follower magnet 220, which may improve the magnetic coupling formed via the magnetic field.

As illustrated, the secondary follower magnet 220 may be axially aligned with the secondary driver magnet 218 such that the at least one follower magnet 212 may be magnetically engaged with the secondary driver magnet 218. As such, the secondary follower magnet 220 may be configured to move along the central bore 204, with respect to the insert frame 304 in response to axial movement of the secondary driver magnet 218 along the control line 108. As set forth above, the secondary driver magnet 218 may be configured to move in the axially downhole direction 230 along the control line 108 from a first secondary driver magnet position toward a second secondary driver magnet position in response to hydraulic pressure in the control line 108 exceeding the threshold pressure. Thus, the secondary follower magnet 220 may be configured to move in the axially downhole direction 230 in response to hydraulic pressure in the control line 108 exceeding the threshold pressure. Further, as the secondary follower magnet 220 is secured to the insert flow tube 320, the insert flow tube 320 may be configured to move in the axially downhole direction 230 from the from the first insert tube position toward the second insert tube position to open the insert flapper 224 in response to the hydraulic pressure in the control line 108 exceeding the threshold pressure and the corresponding axially downhole movement of the secondary driver magnet 218 and the secondary follower magnet 220.

Figure 4:
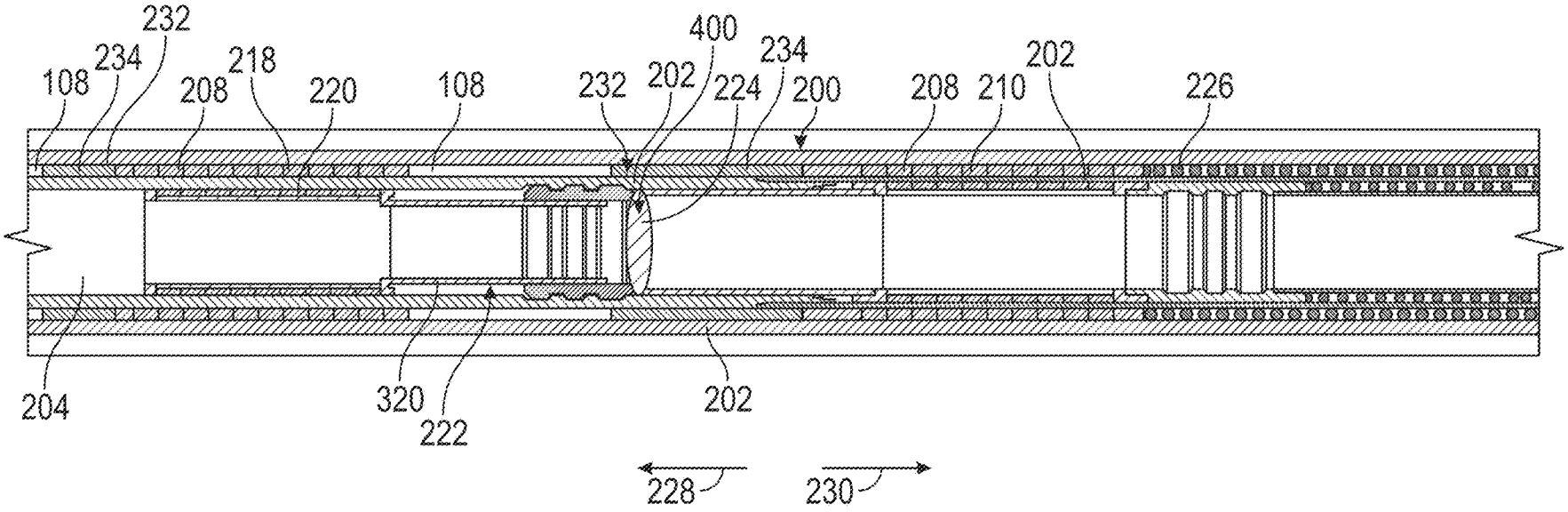
FIG. 4 illustrates a cross-sectional view of the magnetically driven downhole insert valve disposed in a closed position, in accordance with some embodiments of the present disclosure.

FIG. 4 illustrates a cross-sectional view of the magnetically driven downhole insert valve disposed in a closed position, in accordance with some embodiments of the present disclosure. As set forth above, the tubing retrievable safety valve 200 may include the spring 226 configured to bias the at least one driver magnet 208 in the uphole direction 228. Indeed, the spring 226 may include a compression spring configured to compress in response to axially downhole movement of the driver feature 232 and the at least one driver magnet 208. The driver feature 232 (e.g., the at least one piston 234) may be directly or indirectly coupled to the spring 226 such that downhole movement of the driver feature 232 may be restrained until the driver feature 232 exerts sufficient force to compress the spring 226 and move in the downhole direction 230.

For example, the driver feature (e.g., the at least one piston 234) may be directly or indirectly coupled to the spring 226 such that downhole movement of the at least one piston 234 may be restrained until the pressure in the control line 108 above the at least one piston 234 exceeds the threshold pressure needed to provide sufficient force for the at least one piston 234 to compress the spring 226 and move in the downhole direction 230. Further, as set forth above, downhole movement of the driver feature 232 and the at least one driver magnet 208 from the hydraulic pressure in the control line 108 exceeding the threshold pressure may also be configured drive the insert flow tube 320 may to move in the axially downhole direction 230 from the from the first insert tube position toward the second insert tube position to open the insert flapper 224.

However, as illustrated, the at least one driver magnet 208 (e.g., the primary driver magnet 210 and/or the secondary driver magnet 218) may be configured to move in the uphole direction 228 in response to hydraulic pressure in the control line 108 dropping below the threshold pressure. In particular, the spring 226, which is compressed with the insert flapper 224 in the open position, may be configured to directly or indirectly drive the at least one driver magnet 208 in the uphole direction 228 in response to the hydraulic pressure in the control line 108 dropping below the threshold pressure.

As set forth above, the secondary follower magnet 220 is configured to move in response to movement of the secondary driver magnet 218 due to the magnetic coupling set forth above. As such, the secondary follower magnet 220 may be configured to move in the uphole direction 228 in response to the spring 226 driving the secondary driver magnet 218 in the uphole direction 228. Such movement of the secondary follower magnet 220 is configured to drive the insert flow tube 320 to move in the uphole direction 228 from the second insert tube position (e.g., downhole position) to the first insert tube position (e.g., uphole from the insert flapper 224).

As set forth above, the insert flow tube 320 is configured to contact the insert flapper 224 in the second insert tube position to hold the insert flapper 224 in the open position. However, as the insert flow tube 320 moves toward the first insert tube position (e.g., uphole from the insert flapper 224), the insert flow tube 320 is configured to move out of contact with the insert flapper 224 such that the insert flapper 224 may move (e.g., hinge, pivot, rotate, etc.) to the closed position. The insert valve 222 may include a biasing mechanism 400 (e.g., torsion spring, compression spring, etc.) configured to bias the insert flapper 224 toward the closed position. Alternatively, or additionally, fluid flow in the central bore 204 may be configured to drive the insert flapper 224 toward the closed position. Opening and closing the insert flapper 224 may permit the insert valve 222 to control flow through the central bore 204 of the downhole tubular 202.

Figure 5:
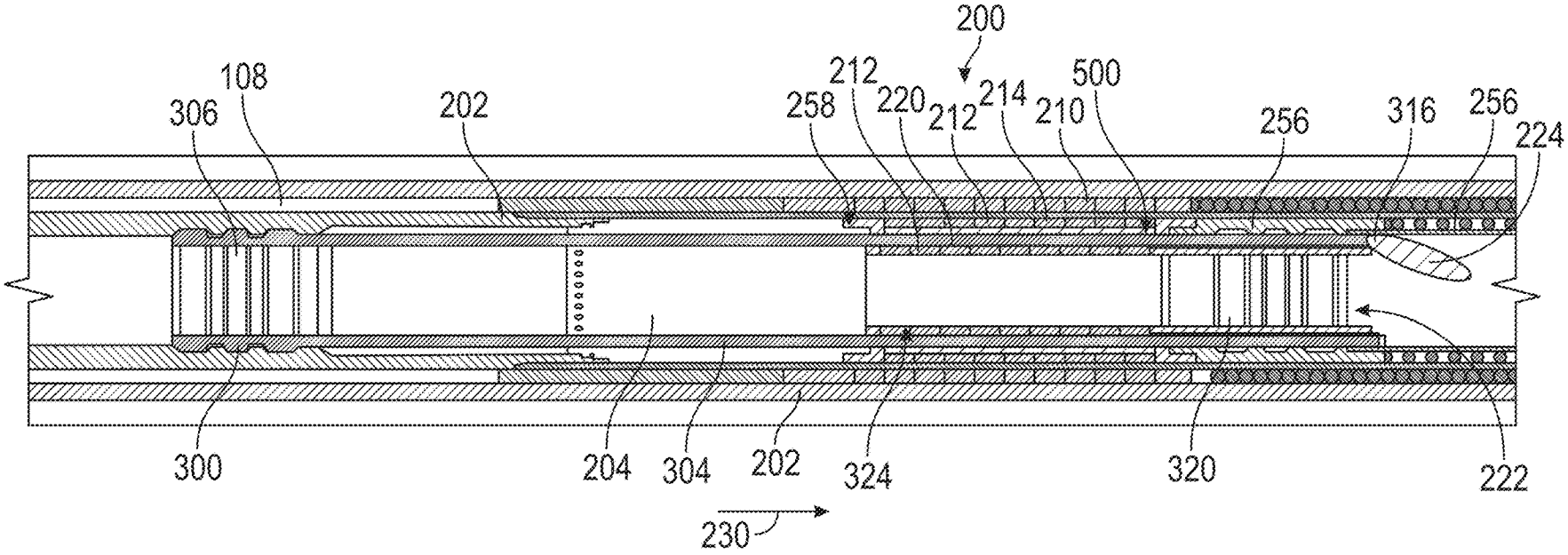
FIG. 5 illustrates a cross-sectional view of a magnetically driven downhole insert valve disposed in an open position and having a secondary follower magnet aligned with a primary follower magnet of a tubing retrievable safety valve, in accordance with some embodiments of the present disclosure.

FIG. 5 illustrates a cross-sectional view of a magnetically driven downhole insert valve disposed in an open position and having a secondary follower magnet aligned with a primary follower magnet of a tubing retrievable safety valve, in accordance with some embodiments of the present disclosure. As illustrated, the tubing retrievable safety valve 200 includes the primary driver magnet 210 disposed in the control line 108 formed in the downhole tubular 202. As set forth above, the primary driver magnet 210 is configured to move axially along the control line 108 in response to hydraulic pressure in the control line 108 exceeding the threshold pressure. Further, the tubing retrievable safety valve 200 may include the primary follower magnet 214 secured to the primary flow tube 256. As set forth above, the primary follower magnet 214 may be magnetically engaged with the primary driver magnet 210 such that the primary follower magnet 214 is configured to move axially with respect to the downhole tubular 202 in response to movement of the primary driver magnet 210.

Moreover, the insert valve 222 may be secured within the tubing retrievable safety valve 200 to form a backup and/or replacement valve for the tubing retrievable safety valve 200. The insert valve 222 may operate to open and close fluid flow through the central bore 204 of the downhole tubular 202 of the tubing retrievable safety valve 200. As illustrated, the insert valve 222 may be run-in-hole to the downhole tubular 202. With the insert valve 222 disposed in the central bore 204 of the downhole tubular 202, the insert valve 222 may interface with an inner surface 258 of the central bore 204 to secure the insert valve 222 to the tubing retrievable safety valve 200. For example, the tubing retrievable safety valve 200 may include the landing nipple 306 formed on the inner surface 258 of the downhole tubular 202. The insert lock 300 of the insert valve 222 may be configured to interface with the landing nipple 306 to secure the insert valve 222 to the tubing retrievable safety valve 200.

Further, as set forth above, the insert valve 222 may include the insert frame 304 connected to the insert lock 300. As illustrated, the insert frame 304 may be connected to a downhole end of the insert lock 300. The insert frame 304 may be configured to extend through at least a portion of a primary through bore 500 of the primary flow tube 256 such that the insert flow tube 320 and the primary flow tube 256 are at least partially overlapping. Further, the insert valve 222 may include the insert flapper 224, which may be connected to the downhole end of the insert frame 304 via the hinged connection 316 or any other suitable connection. As set forth above, the insert flapper 224 is configured to actuate between an open and closed position to control fluid flow through the central bore 204. In particular, the insert flow tube 320 of the insert valve 222 may be configured to drive the insert flapper 224 between the open position and the closed position. That is, moving the insert flow tube 320 from the first insert tube position (e.g., uphole position) to the second insert tube position (e.g., downhole position) is configured to move the insert flow tube 320 into contact with the insert flapper 224 to drive the insert flapper 224 from the closed position to the open position.

Moreover, the insert valve 222 may include the secondary follower magnet 220 secured to the insert flow tube 320. As set forth above, the insert flow tube 320 may include the magnet housing portion 324 configured to receive the at least one follower magnet 212 (e.g., the secondary follower magnet 220). As illustrated, the magnet housing portion 324 of the insert flow tube 320 may be disposed in a position to axially align the secondary follower magnet 220 with the primary follower magnet 214. Indeed, as set forth above, the insert frame 304 may extend in an axially downhole direction 230 from the insert lock 300 such that the secondary follower magnet 220 may be axially aligned with the primary follower magnet 214.

The secondary follower magnet 220 may be configured to magnetically engage with the primary follower magnet 214 and, as set forth above, the primary follower magnet 214 may be configured to magnetically engage with the primary driver magnet 210. Accordingly, movement of the primary driver magnet 210 may drive movement of the secondary follower magnet 220 via each magnet's respective coupling. Thus, the secondary follower magnet 220 may be configured to move axially with respect to the downhole tubular 202 in response to movement of the primary driver magnet 210 to drive the insert flow tube 320 between the first insert tube position and the second insert tube position; thereby, driving the insert flapper 224 from the closed position to the open position.

Figure 6:
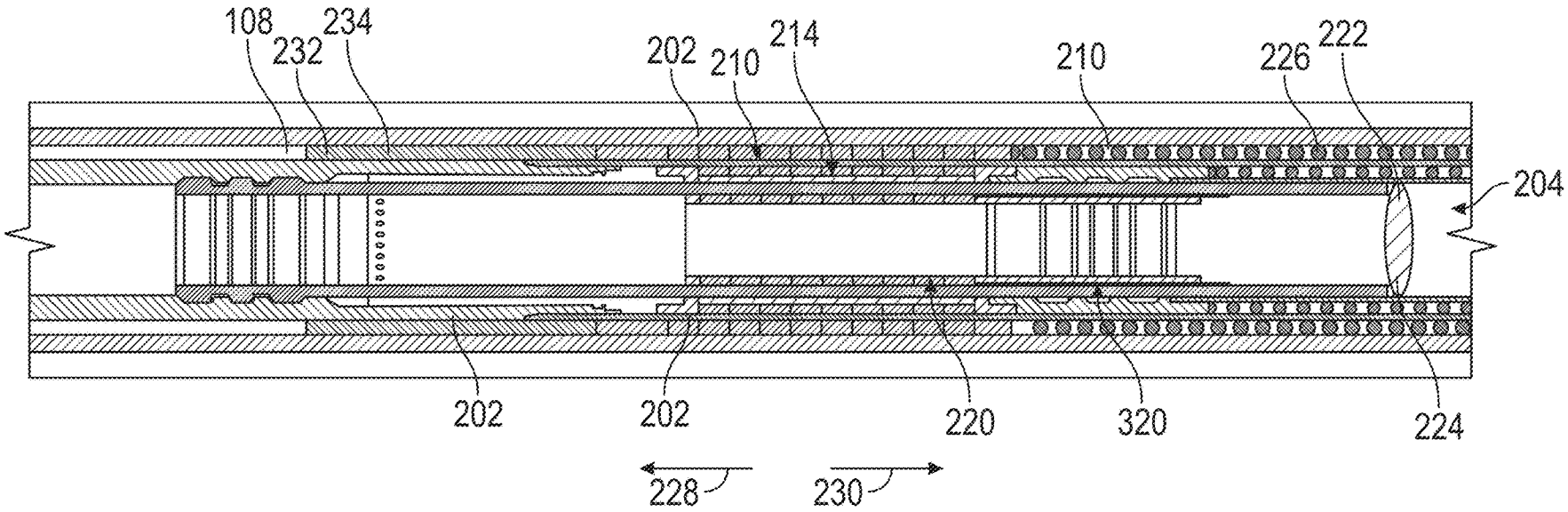
FIG. 6 illustrates a cross-sectional view of a magnetically driven downhole insert valve having a secondary follower magnet aligned with a primary follower magnet of a tubing retrievable safety valve and disposed in a closed position, in accordance with some embodiments of the present disclosure.

FIG. 6 illustrates a cross-sectional view of a magnetically driven downhole insert valve having a secondary follower magnet aligned with a primary follower magnet of a tubing retrievable safety valve and disposed in a closed position, in accordance with some embodiments of the present disclosure. The primary driver magnet 210 (e.g., an outer driver magnet) may be biased to move in the uphole direction 228 along the control line 108. For example, the spring 226 may be disposed within the control line 108 in a position downhole with respect to the primary driver magnet 210. The spring 226 (e.g., a compression spring) may be configured to bias the primary driver magnet 210 in the uphole direction 228 in response to the driver feature 232 (e.g., the at least one piston 234) and/or the primary driver magnet 210 compressing the spring 226. As set forth above, having hydraulic pressure in the control line 108 that is above the threshold pressure may result in the driver feature 232 and/or the primary driver magnet 210 being driven in the downhole direction 230 and into the spring 226 and toward the second primary driver magnet position, which may result in the spring 226 compressing.

However, in response to hydraulic pressure in the control line 108 dropping below the threshold pressure, the force on the driver feature 232 and the primary driver magnet 210 in the downhole direction 230 may be smaller than a spring force from the spring 226, such that the spring 226 may drive the primary driver magnet 210 in the uphole direction 228 toward the first primary driver magnet position (e.g., uphole position).

Further, as illustrated, movement of the primary driver magnet 210 may drive movement of the secondary follower magnet 220. That is, the primary driver magnet 210 may be configured to project a first magnetic field toward the central bore 204. The primary follower magnet 214 (e.g., an inner driver magnet) may be magnetically coupled to the primary driver magnet 210 (e.g., the outer driver magnet) via the first magnetic field. Further, the primary follower magnet 214 may be configured to project a second magnetic field radially inward. The secondary follower magnet 220 may be magnetically coupled to the primary follower magnet 214, via the second magnetic field. As such, movement of the primary driver magnet 210 may drive movement of the secondary follower magnet 220. Accordingly, in response to the hydraulic pressure dropping below the threshold pressure, the secondary follower magnet 220 is configured to move in the uphole direction 228 due to the uphole movement of the primary driver magnet 210.

Such movement of the secondary follower magnet 220 may drive the insert flow tube 320 in the uphole direction 228 to move the insert flow tube 320 out of contact with the insert flapper 224. Without the insert flow tube 320 holding the insert flapper 224 in the open position, the insert flapper 224 may move to the closed position. Indeed, the insert flapper 224 may be biased to move from the open position toward the closed position. Opening and closing the insert flapper 224 may permit the insert valve 222 to control flow through the central bore 204 of the downhole tubular 202.

Figure 7:
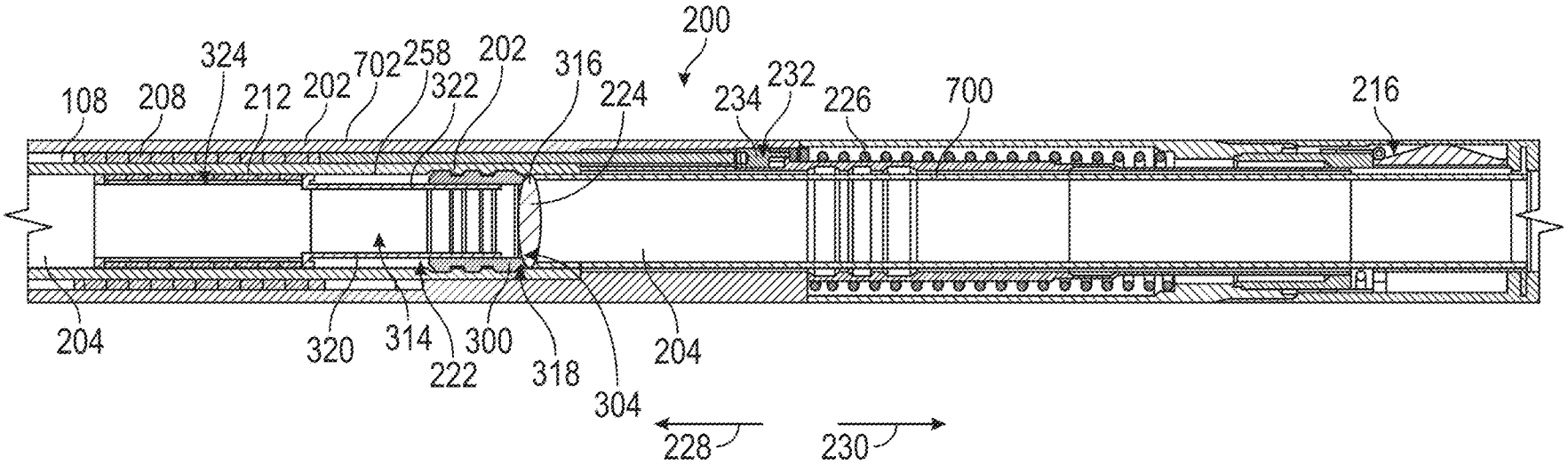
FIG. 7 illustrates a cross-sectional view of a magnetically driven downhole insert valve secured to a hydraulic tubing retrievable safety valve, in accordance with some embodiments of the present disclosure.

FIG. 7 illustrates a cross-sectional view of a magnetically driven downhole insert valve secured to a hydraulic tubing retrievable safety valve, in accordance with some embodiments of the present disclosure. The tubing retrievable safety valve 200 may be configured to move the primary flapper valve 216 from the closed position toward the open position in response to hydraulic pressure in the control line 108 above the driver feature 232 (e.g., the at least one drive piston) driving the driver feature 232 in the downhole direction 230. However, as set forth above, the primary flapper valve 216 may fail due to wear and tear. Thus, as illustrated, a holding tube 700 (e.g., a stay-open tube) configured to hold the primary flapper valve 216 in the open position may be run-in-hole to a corresponding position in the central bore 204 for holding the primary flapper valve 216 in the open position. Additionally, the insert valve 222 may be run-in-hole and secured to the inner surface 258 of the central bore 204 of the downhole tubular 202 of the tubing retrievable safety valve 200. As illustrated, the holding tube 700 may be disposed downhole from the insert valve 222. However, the holding tube 700 may be disposed in any suitable position.

Moreover, as set forth above, the insert valve 222 may include the insert lock 300 configured to interface with the inner surface 258 of the central bore 204 of the downhole tubular 202 to secure the insert lock 300 to the tubing retrievable safety valve 200. Further, the insert valve 222 may include the insert frame 304 secured to the insert lock 300. As set forth above, the insert frame 304 and the insert lock 300 may both include substantially tubular shapes and may be substantially radially aligned to form the insert through bore 314 extending through both the insert lock 300 and the insert frame 304. Additionally, the insert valve 222 may include the insert flapper 224, which may be at least partially secured to the insert frame 304 such that the insert flapper 224 may actuate between an open and closed position to control fluid flow through the central bore 204. For example, the insert flapper 224 may be connected to the downhole end of the insert frame 304 via the hinged connection 316 such that the insert flapper 224 may hinge between the open position and the closed position. Further, the valve seat 318 may be formed at a downhole end of the insert frame 304 such that the insert flapper 224 may be configured to seal against the valve seat 318 in the closed position to block fluid flow through the central bore 204.

Moreover, the insert valve 222 may include an insert flow tube 320 configured to drive the insert flapper 224 between the open position and the closed position. That is, the insert flow tube 320 is configured to move between the first insert tube position (e.g., uphole position) and the second insert tube position (e.g., downhole position). As illustrated, in the first insert tube position, the interface portion 322 of the insert flow tube 320 may be disposed uphole from the insert flapper 224. However, as the insert flow tube 320 moves from the first insert tube position toward the second insert tube position, the interface portion 322 is configured to move through the insert through bore 314 and contact the insert flapper 224. Continued movement of the insert flow tube 320 in the downhole direction 230 toward the second insert tube position is configured to drive the insert flapper 224 to move (e.g., hinge, pivot, rotate, etc.) from the closed position toward the open position.

The insert valve 222 may further include the at least one follower magnet 212, which may be secured to the insert flow tube 320. The at least one follower magnet 212 may be secured to any suitable portion of the insert flow tube 320. For example, the at least one follower magnet 212 may be disposed about the circumference of the magnet housing portion 324 of the insert flow tube 320. Moreover, the at least one follower magnet 212 of the insert valve 222 may be axially aligned with the at least one driver magnet 208 of the tubing retrievable safety valve 200 such that at least one follower magnet 212 may be magnetically coupled with the at least one driver magnet 208.

The at least one driver magnet 208 may be disposed within the control line 108 extending through at least a portion of the downhole tubular 202 of the tubing retrievable safety valve 200. The at least one driver magnet 208 is configured to project a magnetic field into the central bore 204 to magnetically couple the at least one driver magnet 208 with the at least one follower magnet 212. Moreover, the at least one driver magnet 208 is configured to move axially along the control line 108 between a first driver magnet position (e.g., uphole position) and a second driver magnet position (e.g., downhole position). In particular, the at least one driver magnet 208 may be configured to move axially along the control line 108 in response to hydraulic pressure in the control line 108 exceeding a threshold pressure. As set forth above, hydraulic pressure in the control line 108 above the driver feature 232 (e.g., the at least one piston 234) may be configured to drive the driver feature 232 in the downhole direction 230. As illustrated, the driver feature 232 may be mechanically connected to the at least one driver magnet 208 such that movement of the driver feature 232 is configured to drive movement of the at least one driver magnet 208. The driver feature 232 may be mechanically connected to the at least one driver magnet 208 via a connection feature 702 (e.g., a connection rod or any other suitable connection feature) configured to rigidly connect the driver feature 232 to the at least one driver magnet 208.

Accordingly, the at least one driver magnet 208 and the driver feature 232 may be configured to move in the axially downhole direction 230 with respect to the downhole tubular 202 in response to the hydraulic pressure exceeding the threshold pressure. Additionally, as illustrated, reducing the pressure in the control line 108 below the threshold pressure may allow the spring 226 to drive the driver feature 232 and the at least one driver magnet 208 in the axially uphole direction 228. Generally, moving the driver feature 232 in the uphole direction 228 would cause the primary flapper valve 216 to move to the close position. However, as set forth above, the holding tube 700 may be disposed within the central bore 204 to hold the primary flapper valve 216 in the open position. Instead, as the at least one driver magnet 208 moves in the axially uphole direction 228, the at least one follower magnet 212 of the insert valve 222 may move in the axially uphole direction 228 due to the magnetic coupling. Further, as illustrated, moving the at least one follower magnet 212 in the uphole direction 228 may drive the insert flow tube 320 to move in the uphole direction 228 toward the first insert tube position (e.g., uphole position), which disengages the insert flow tube 320 from the insert flapper 224 such that the insert flapper 224 may move from the open position to the closed position.

Figure 8:
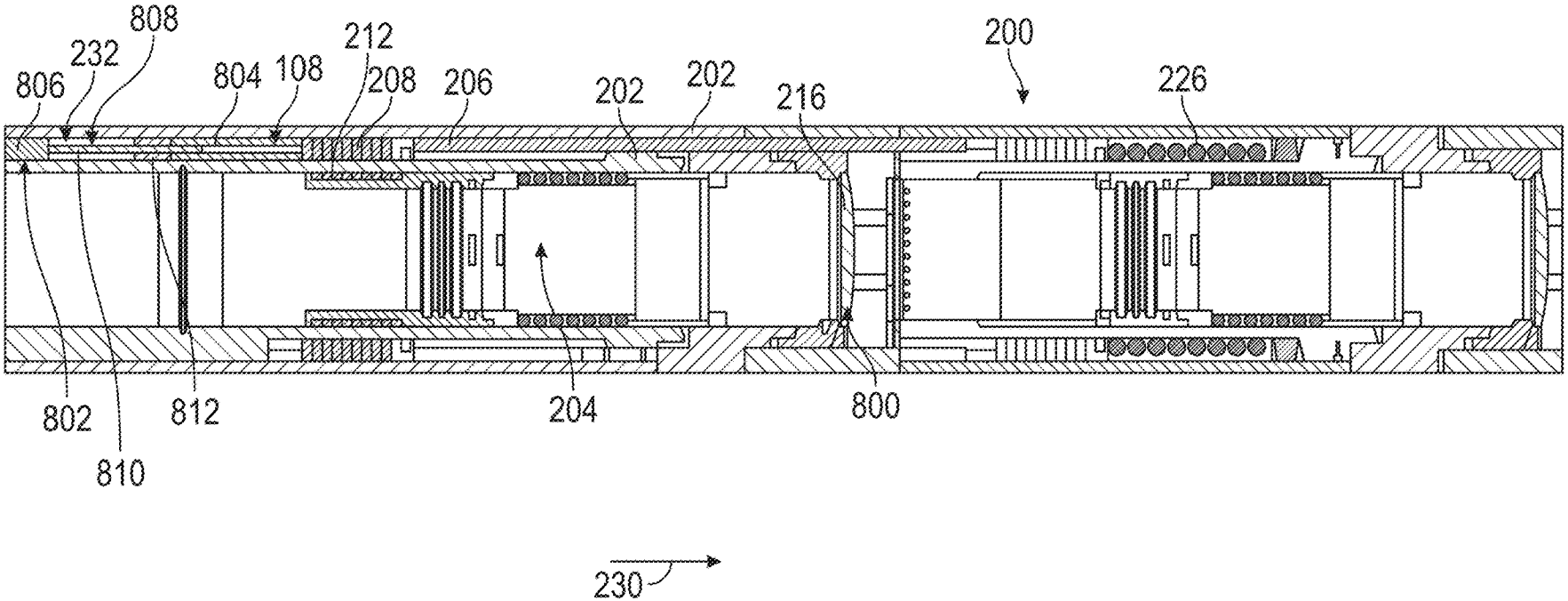
FIG. 8 illustrates a cross-sectional view of a magnetically driven downhole insert valve secured to an electric tubing retrievable safety valve, in accordance with some embodiments of the present disclosure.

FIG. 8 illustrates a cross-sectional view of a magnetically driven downhole insert valve secured to an electric tubing retrievable safety valve, in accordance with some embodiments of the present disclosure. As set forth above, the at least one driver magnet 208 is configured to move axially along the control line 108 between the first driver magnet position and the second driver magnet position. The at least one driver magnet 208 is configured to project a magnetic field into the central bore 204. The magnetic field is configured to interface with at least one follower magnet 212 to actuate a flapper valve 800 (e.g., the primary flapper valve 216 and/or the insert flapper 224 shown in FIG. 3) between a closed position and an open position in response to movement of the at least one driver magnet 208 between the first driver magnet position and the second driver magnet position. Further, as set forth above, actuating the flapper valve 800 between the closed position and the open position may control flow through the central bore 204.

Moreover, as set forth above, tubing retrievable safety valve 200 may include the spring 226 disposed in the control line 108 and configured to bias the at least one driver magnet 208 uphole towards the first driver magnet position. Further, the tubing retrievable safety valve 200 may include the driver feature 232 configured to actuate to drive the at least one driver magnet 208 downhole toward the second driver magnet position. As illustrated, the driver feature 232 may include an electrical actuator 802 disposed at least partially within the control line 108 (e.g., the channel 206) of the downhole tubular 202. The electrical actuator 802 may include an interface member 804 configured to move axially along the control line 108 in the downhole direction 230 in response to actuation of an electrical motor 806 of the electrical actuator 802. The interface member 804 may be configured to contact the at least one driver magnet 208 to drive the at least one driver magnet 208 downhole toward the second driver magnet position.

For example, the electrical actuator 802 may include the electrical motor 806 coupled to a ball screw mechanism 808. In response to actuation of the electrical motor 806, a ball screw 810 of the ball screw mechanism 808 may be configured to rotate. As the ball screw 810 rotates, a ball nut 812 of the ball screw mechanism 808 may move axially along the ball screw 810. An upper end of the interface member 804 (e.g., an extension rod) may be secured to the ball nut 812 and a lower end of the interface member 804 may be secured to the at least one driver magnet 208. As such, the at least one driver magnet 208 may be driven axially between the first driver magnet position and the second driver magnet position in response to movement of the ball nut 812 of the electrical actuator 802. However, any suitable electrical actuator 802 may be used to drive axial movement of the interface member 804 and the at least one driver magnet 208.

Accordingly, the present disclosure may provide a downhole insert valve configured to be actuated via a magnetic coupling between at least one driver magnet of a tubing retrievable safety valve and at least one follower magnet of the downhole insert valve. The systems or downhole insert valves may include any of the various features disclosed herein, including one or more of the following statements.

Statement 1. A downhole insert valve, comprising: an insert frame securable within a central bore of a downhole tubular of a tubing retrievable safety valve, wherein the tubing retrievable safety valve includes at least one driver magnet configured to project a magnetic field into the central bore and move axially along a control line in the downhole tubular between a first position and a second position; an insert flapper connected to the insert frame and configured to actuate between an open position and a closed position to control fluid flow through the central bore; an insert flow tube disposed within the central bore and configured to move between a first insert tube position and a second insert tube position to drive the insert flapper between the closed position and the open position, respectively; and at least one follower magnet secured to the insert flow tube and magnetically engaged with the at least one driver magnet, wherein the at least one follower magnet is configured to move in response to movement of the at least one driver magnet to drive the insert flow tube between the first insert tube position and the second insert tube position.

Statement 2. The downhole insert valve of statement 1, wherein the insert flow tube includes an interface portion and a magnet housing portion, wherein the interface portion is configured to contact the insert flapper to drive the insert flapper between the closed position and the open position, and wherein the magnet housing portion includes at least one recess configured to house the at least one follower magnet.

Statement 3. The downhole insert valve of statement 1 or statement 2, wherein the at least one follower magnet includes a plurality of follower magnets disposed about a circumference of a magnet housing portion of the insert flow tube.

Statement 4. The downhole insert valve of any preceding statement, wherein the at least one follower magnet includes at least one rare earth magnet.

Statement 5. The downhole insert valve of any preceding statement, further comprising a valve seat formed at a downhole end of the insert frame, and wherein the insert flapper is configured to seal against the valve seat in the closed position to block fluid flow through the central bore.

Statement 6. The downhole insert valve of any preceding statement, wherein the insert flapper is connected to a downhole end of the insert frame via a hinged connection, wherein the insert flapper is configured to hinge between the open position and the closed position.

Statement 7. The downhole insert valve of any preceding statement, further comprising an insert lock configured to interface with an inner surface of the downhole tubular to secure the insert frame to the tubing retrievable safety valve.

Statement 8. The downhole insert valve of any preceding statement, wherein the insert lock is configured to interface with a landing nipple formed on the inner surface of the downhole tubular to secure the insert frame to the tubing retrievable safety valve, and wherein the insert lock includes radially extending ridges configured to interface with corresponding grooves of the landing nipple.

Statement 9. The downhole insert valve of any preceding statement, wherein the insert flow tube and the at least one follower magnet are configured to move axially along the central bore, with respect to the insert frame, in response to movement of the at least one driver magnet.

Statement 10. A tubing retrievable safety valve system, comprising: a downhole tubular having a central bore; a primary flapper valve disposed within the central bore and configured to actuate between an open position and closed position to control flow through the central bore; a control line extending axially through at least a portion of the downhole tubular; and at least one driver magnet configured to move axially along the control line between a first position and a second position, wherein the at least one driver magnet is configured to project a magnetic field into the central bore, wherein the magnetic field is configured to interface with at least one follower magnet of an insert valve to actuate an insert flapper of the insert valve between a closed position and an open position in response to movement of the at least one driver magnet between the first position and the second position, and wherein actuating the insert flapper between the closed position and the open position is configured to control flow through the central bore.

Statement 11. The tubing retrievable safety valve system of statement 10, further comprising a holding tube disposed within the central bore, wherein the holding tube is configured to hold the primary flapper valve in an open position.

Statement 12. The tubing retrievable safety valve system of statement 10 or statement 11, further comprising a spring configured to bias the at least one driver magnet toward the first position.

Statement 13. The tubing retrievable safety valve system of any of statements 10-12, further comprising a driver feature configured to actuate to drive the at least one driver magnet toward the second position.

Statement 14. The tubing retrievable safety valve system of any of statements 10-13, wherein the driver feature includes at least one drive piston disposed within the control line, and wherein the at least one drive piston is configured move axially along the control line in response to hydraulic pressure in the control line exceeding a threshold pressure.

Statement 15. The tubing retrievable safety valve system of any of statements 10-14, further comprising an upper seal secured to an upper end of the at least one driver magnet and a lower seal secured to a lower end of the at least one driver magnet, and wherein the at least one driver magnet is fluidly connected to the driver feature.

Statement 16. The tubing retrievable safety valve system of any of statements 10-15, wherein the driver feature is mechanically connected to the at least one driver magnet such that movement of the driver feature is configured to drive movement of the at least one driver magnet.

Statement 17. The tubing retrievable safety valve system of any of statements 10-16, wherein the driver feature includes an electrical actuator disposed at least partially within the control line, wherein the electrical actuator includes an interface member configured to move axially along the control line in response to actuation of a motor of the electrical actuator.

Statement 18. The tubing retrievable safety valve system of any of statements 10-17, further comprising the insert valve, wherein the insert valve comprises: the insert flapper configured to actuate between the open position and the closed position to control fluid flow through the central bore; an insert flow tube configured to move axially along the central bore between a first insert tube position and a second insert tube position, wherein the insert flow tube is configured to contact the insert flapper to drive the insert flapper between the closed position and the open position, respectively; and the at least one follower magnet, wherein the at least one follower magnet is secured to the insert flow tube and magnetically engaged with the at least one driver magnet, wherein the at least one follower magnet is configured to move in response to movement of the at least one driver magnet to drive the insert flow tube between the first insert tube position and the second insert tube position.

Statement 19. The tubing retrievable safety valve system of any of statements 10-17, wherein the at least one driver magnet includes an outer driver magnet and an inner driver magnet, wherein the outer driver magnet is configured to move axially along the control line between the first position and a second position and project a first magnetic field into the central bore, wherein the inner driver magnet is secured to a primary flow tube disposed within the central bore, wherein the inner driver magnet is configured to project a second magnetic field radially inward, and wherein the second magnetic field is configured to interface with the at least one follower magnet of the insert valve to actuate the insert flapper in response to movement of the outer driver magnet and the inner driver magnet.

Statement 20. A tubing retrievable safety valve system, comprising: a downhole tubular having a central bore; a primary flapper valve disposed within the central bore and configured to actuate between an open position and closed position to control flow through the central bore; a control line extending axially through at least a portion of the downhole tubular; at least one driver magnet configured to move axially along the control line between a first position and a second position, wherein the at least one driver magnet is configured to project a magnetic field into the central bore, wherein the magnetic field is configured to interface with at least one follower magnet of an insert valve to actuate an insert flapper of the insert valve between a closed position and an open position in response to movement of the at least one driver magnet between the first position and the second position, and wherein actuating the insert flapper between the closed position and the open position is configured to control flow through the central bore; a spring configured to bias the at least one driver magnet toward the first position; and a driver feature configured to actuate to drive the at least one driver magnet toward the second position, wherein the driver feature includes at least one drive piston disposed within the control line, and wherein the at least one drive piston is configured move axially along the control line in response to hydraulic pressure in the control line exceeding a threshold pressure.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. For example, the magnets set forth above (e.g., primary driver magnet, secondary driver magnet, primary follower magnet, secondary follower magnet, etc.) may each include a single magnet or a group of magnets. For example, each magnet may include a group of magnets forming a Halbach array or any other suitable array for interacting with a corresponding magnet or group of magnets. The arrays may include multiple permanent magnets where the direction of the magnetic field of permanent magnets changes with axial position. For example, the magnetic field may alternate with axial position. In particular, the north on the first magnet may point uphole while north on the second magnet may point downhole, and the north on the third magnet may point uphole again. Alternatively, as set forth above, the magnetic field may be rotated to create the Halbach array.

Further, the magnets are preferably formed in a circumferential ring. The circumferential ring may be a continuous magnet. Alternatively, the circumferential ring may be discontinuous and constructed from an array of discrete magnets. For example, sixteen discrete magnets may be epoxied together to create the circumferential ring.

Moreover, although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole insert valve, comprising:

an insert frame securable within a central bore of a downhole tubular of a tubing retrievable safety valve, wherein the tubing retrievable safety valve includes a primary driver magnet and a secondary driver magnet each configured to project a magnetic field into the central bore and move axially along a control line in the downhole tubular between respective first positions and second positions, wherein the primary driver magnet is axially offset from the secondary driver magnet along the control line, and wherein the tubing retrievable safety valve includes a primary follower magnet magnetically engaged with the primary driver magnet and configured to drive actuation of a primary flapper between an open position and a closed position;

an insert flapper connected to the insert frame and configured to actuate between an open position and a closed position to control fluid flow through the central bore;

an insert flow tube disposed within the central bore and configured to move between a first insert tube position and a second insert tube position to drive the insert flapper between the closed position and the open position, respectively; and a secondary follower magnet secured to the insert flow tube and magnetically engaged with the secondary driver magnet, wherein the secondary follower magnet is configured to move in response to movement of the secondary driver magnet to drive the insert flow tube between the first insert tube position and the second insert tube position.

2. The downhole insert valve of claim 1, wherein the insert flow tube includes an interface portion and a magnet housing portion, wherein the interface portion is configured to contact the insert flapper to drive the insert flapper between the closed position and the open position, and wherein the magnet housing portion includes at least one recess configured to house the secondary follower magnet.

3. The downhole insert valve of claim 1, wherein the secondary follower magnet includes a plurality of follower magnets disposed about a circumference of a magnet housing portion of the insert flow tube.

4. The downhole insert valve of claim 1, wherein the secondary follower magnet includes at least one rare earth magnet.

5. The downhole insert valve of claim 1, further comprising a valve seat formed at a downhole end of the insert frame, and wherein the insert flapper is configured to seal against the valve seat in the closed position to block fluid flow through the central bore.

6. The downhole insert valve of claim 1, wherein the insert flapper is connected to a downhole end of the insert frame via a hinged connection, wherein the insert flapper is configured to hinge between the open position and the closed position.

7. The downhole insert valve of claim 1, further comprising an insert lock configured to interface with an inner surface of the downhole tubular to secure the insert frame to the tubing retrievable safety valve.

8. The downhole insert valve of claim 7, wherein the insert lock is configured to interface with a landing nipple formed on the inner surface of the downhole tubular to secure the insert frame to the tubing retrievable safety valve, and wherein the insert lock includes radially extending ridges configured to interface with corresponding grooves of the landing nipple.

9. The downhole insert valve of claim 1, wherein the insert flow tube and the secondary follower magnet are configured to move axially along the central bore, with respect to the insert frame, in response to movement of the at least one driver magnet.

10. A tubing retrievable safety valve system, comprising:

a downhole tubular having a central bore;

a primary flapper valve disposed within the central bore and configured to actuate between an open position and closed position to control flow through the central bore;

a control line extending axially through at least a portion of the downhole tubular; and at least one driver magnet configured to move axially along the control line between a first position and a second position, wherein the at least one driver magnet is configured to project a magnetic field into the central bore, wherein the magnetic field is configured to interface with at least one follower magnet of an insert valve to actuate an insert flapper of the insert valve between a closed position and an open position in response to movement of the at least one driver magnet between the first position and the second position, and wherein actuating the insert flapper between the closed position and the open position is configured to control flow through the central bore, wherein the at least one driver magnet includes an outer driver magnet and an inner driver magnet, wherein the outer driver magnet is configured to move axially along the control line between the first position and a second position and project a first magnetic field into the central bore, wherein the inner driver magnet is secured to a primary flow tube disposed within the central bore, wherein the inner driver magnet is configured to project a second magnetic field radially inward, and wherein the second magnetic field is configured to interface with the at least one follower magnet of the insert valve to actuate the insert flapper in response to movement of the outer driver magnet and the inner driver magnet.

11. The tubing retrievable safety valve system of claim 10, further comprising a holding tube disposed within the central bore, wherein the holding tube is configured to hold the primary flapper valve in an open position.

12. The tubing retrievable safety valve system of claim 10, further comprising a spring configured to bias the at least one driver magnet toward the first position.

13. The tubing retrievable safety valve system of claim 10, further comprising at least one drive piston disposed within the control line and configured to actuate to drive the at least one driver magnet toward the second position, wherein the at least one drive piston is configured move axially along the control line in response to hydraulic pressure in the control line exceeding a threshold pressure.

14. A tubing retrievable safety valve system, comprising:

a downhole tubular having a central bore;

a primary flapper valve disposed within the central bore and configured to actuate between an open position and closed position to control flow through the central bore;

a control line extending axially through at least a portion of the downhole tubular;

at least one driver magnet configured to move axially along the control line between a first position and a second position, wherein the at least one driver magnet is configured to project a magnetic field into the central bore, wherein the magnetic field is configured to interface with at least one follower magnet of an insert valve to actuate an insert flapper of the insert valve between a closed position and an open position in response to movement of the at least one driver magnet between the first position and the second position, and wherein actuating the insert flapper between the closed position and the open position is configured to control flow through the central bore; and an upper seal secured to an upper end of the at least one driver magnet and a lower seal secured to a lower end of the at least one driver magnet, and wherein the at least one driver magnet is fluidly connected to at least one drive piston configured to actuate to drive the at least one driver magnet toward the second position.

15. The tubing retrievable safety valve system of claim 13, wherein the at least one drive piston is mechanically connected to the at least one driver magnet such that movement of the at least one drive piston is configured to drive movement of the at least one driver magnet.

16. The tubing retrievable safety valve system of claim 10, further comprising an electrical actuator disposed at least partially within the control line and configured to actuate to drive the at least one driver magnet toward the second position, wherein the electrical actuator includes an interface member configured to move axially along the control line in response to actuation of a motor of the electrical actuator.

17. The tubing retrievable safety valve system of claim 10, further comprising the insert valve, wherein the insert valve comprises:

the insert flapper configured to actuate between the open position and the closed position to control fluid flow through the central bore;

an insert flow tube configured to move axially along the central bore between a first insert tube position and a second insert tube position, wherein the insert flow tube is configured to contact the insert flapper to drive the insert flapper between the closed position and the open position, respectively; and the at least one follower magnet, wherein the at least one follower magnet is secured to the insert flow tube and magnetically engaged with the at least one driver magnet, wherein the at least one follower magnet is configured to move in response to movement of the inner driver magnet to drive the insert flow tube between the first insert tube position and the second insert tube position.

18. A tubing retrievable safety valve system, comprising:

a downhole tubular having a central bore;

a primary flapper valve disposed within the central bore and configured to actuate between an open position and closed position to control flow through the central bore;

a control line extending axially through at least a portion of the downhole tubular;

at least one driver magnet configured to move axially along the control line between a first position and a second position, wherein the at least one driver magnet is configured to project a magnetic field into the central bore, wherein the magnetic field is configured to interface with at least one follower magnet of an insert valve to actuate an insert flapper of the insert valve between a closed position and an open position in response to movement of the at least one driver magnet between the first position and the second position, and wherein actuating the insert flapper between the closed position and the open position is configured to control flow through the central bore;

a spring configured to bias the at least one driver magnet toward the first position; and a driver feature configured to actuate to drive the at least one driver magnet toward the second position, wherein the driver feature includes at least one drive piston disposed within the control line, and wherein the at least one drive piston is configured move axially along the control line in response to hydraulic pressure in the control line exceeding a threshold pressure.

19. The tubing retrievable safety valve system of claim 1, further comprising at least one drive piston disposed within the control line and configured to actuate to drive the secondary driver magnet toward the second position, wherein the at least one drive piston is configured move axially along the control line in response to hydraulic pressure in the control line exceeding a threshold pressure.

20. The tubing retrievable safety valve system of claim 1, further comprising an electrical actuator disposed at least partially within the control line and configured to actuate to drive the primary driver magnet and the secondary driver magnet toward their respective second positions, wherein the electrical actuator includes an interface member configured to move axially along the control line in response to actuation of a motor of the electrical actuator.

* * * * *